US006194359B1

(12) United States Patent
Beyer et al.

(10) Patent No.: US 6,194,359 B1
(45) Date of Patent: Feb. 27, 2001

(54) OPERATING FLUID FOR LIFETIME LUBRICATED INTERNAL COMBUSTION ENGINES

(75) Inventors: Ludwig Beyer, Meerbusch; Herbert Gasthuber, Ulm; Heiner Müske, Ratingen; Mathias Woydt, Berlin, all of (DE)

(73) Assignees: Fragol Schmierstoff GmbH & Co. KG, Mulheim; DaimlerChrysler AG, Stuttgart, both of (DE)

( * ) Notice: Subject to any disclaimer, the term of this patent is extended or adjusted under 35 U.S.C. 154(b) by 0 days.

(21) Appl. No.: 09/308,159

(22) PCT Filed: Sep. 20, 1997

(86) PCT No.: PCT/EP97/05166

§ 371 Date: Jul. 16, 1999

§ 102(e) Date: Jul. 16, 1999

(87) PCT Pub. No.: WO98/22559

PCT Pub. Date: May 28, 1998

(30) Foreign Application Priority Data

Nov. 16, 1996 (DE) ..... 196 47 554

(51) Int. Cl.[7] ..... C10M 129/76; C10M 133/44; C10M 137/08; C10M 169/04

(52) U.S. Cl. ..... 508/279; 508/282; 508/495

(58) Field of Search ..... 508/279, 282, 508/495

(56) References Cited

U.S. PATENT DOCUMENTS 2,250,049 * 7/1941 Majle .
3,254,027 * 5/1966 Matson et al. .
3,697,427 * 10/1972 Byford et al. .
3,833,502 * 9/1974 Leary et al. .
3,914,179 * 10/1975 Byford et al. .
3,931,022 * 1/1976 Chesluk et al. .
4,101,431 * 7/1978 Kuntschik .
4,654,155 * 3/1987 Kipp et al. .
4,701,273 * 10/1987 Brady et al. .

FOREIGN PATENT DOCUMENTS 0368803 5/1990 (EP) .
07923 * 5/1992 (EP) .
0594320 4/1994 (EP) .

* cited by examiner

*Primary Examiner*—Margaret Medley
(74) *Attorney, Agent, or Firm*—Wenderoth, Lind & Ponack, L.L.P.

(57) ABSTRACT

The operational fluid according to the invention is well suited for the lifelong lubrication and cooling of combustion engines. It comprises as the basic fluid a polyalkylene glycol produced from ethylene oxide and propylene oxide and an additive mixture comprising a) 0.012–1.0 percent by weight of a reaction product of diphenyl amine and 2,4,4-trimethyl pentene; b) 0.01–1.0 percent by weight of a pentaerythritol partially or completely esterified with an alkyl-substituted p-hydroxy propionic acid; c) 0.01–1.0 percent by weight of a mono- or di-($C_4$–$C_8$) alkyl phosphoric acid ($C_{10}$–$C_{15}$) alkyl amide; d) 0.01–1.0 percent by weight of triphenyl thiophosphate; e) 0.01–0.1 percent by weight of a tolutriazol amino-methylated with a straight-chain or branched alkyl group with 2–10 carbon atoms, and/or f) 0.01–0.1 percent by weight of 1H-benzotriazol.

8 Claims, No Drawings

OPERATING FLUID FOR LIFETIME LUBRICATED INTERNAL COMBUSTION ENGINES

This application is a 371 of PCT/EP97/05166 dated Sep. 20, 1997.

Subject matter of the invention is an operational fluid for lifetime-lubricated combustion engines, which combines the properties of a lubricant and a cooling fluid and, based on its novel composition, exhibts considerable advantages relative to known motor oils. It is applied in combustion engines which are produced of conventional metallic materials, but primarily also in engines comprising ceramic parts.

Classic combustion engines comprise a multiplicity of main structural elements such as pistons, piston rings, piston bolts, connecting rods, connecting rod bearings, [cylinder] liners, crankshafts, crankshaft bearings, camshafts, valves, valve guides and valve gear elements, which move against one another at relatively high speed and in the process traverse considerable wear paths. These structural elements are typically produced of metallic materials such as cast iron, steel, aluminum, brass and bronze alloys and are therefore subject to wear typical for the system.

In order to keep the friction between the structural parts at a minimum and thus to hold the wear at a low level, the friction sites of these combustion engines are supplied with lubricants which are conventionally comprised of hydrocarbons, mineral oils or also synthetic oils. The valve gear, to be sure highly loaded tribologically but rather minimally by temperature and contaminants, is supplied from the same oil reservoir as the thermally highly stressed crank gear laden with combustion residues. The operating life and changing intervals of the oil are determined by the latter.

To fulfil the manifold lubrication tasks, additives are mixed into the motor oils, which are intended to enlarge the spectrum of the performance of the motor oil and which, each by itself or in combination, have to carry out highly specific tasks. A considerable portion of these additives serves for the purpose of protecting the metallic materials sliding one upon another against wear, corrosion or welding together (seizing up).

Up to 35 percent of the particle emissions of a diesel engine have their origin in motor oils. The same applies to the hydrocarbons in the exhaust gas of Otto engines. A considerable fraction of the particle emissions comprises non-combusting additives such as phosphor, sulfur, zinc or barium compounds and many others which not only increase the soot particle emission but also contaminate the exhaust gas catalysts, which become consumed and must therefore be replaced as soon as the value falls below the value of the effective minimum concentration in the basic oil.

More recent materials such as hard metals, monolithic and stratified ceramics, sintered ceramics, carbon and tribological coatings today permit, in connection with constructional measures, new solutions for lubricating the combustion engine with far lower lubricant consumption than occurs in conventional combustion engines produced of conventional metallic materials.

Since, in the case of combustion engines produced of newer materials, in the following referred to simply as "ceramic engines", the surfaces of the parts sliding against one another are no longer of only a metallic nature, the lubricants required for them can dispense with all additives which are today intended to protect [these parts] against corrosion or to prevent at all cost the material contact of the surfaces sliding against one another. The significantly better wear resistance of the listed newer materials (some have no tendency at all to seize) permits a considerably greater portion of mixed friction than is possible in the case of conventional engines comprising metallic materials.

Under these mixed friction conditions—or even when running dry—through the partial omission of the wear-reducing fluid lubrication, subsequently material substitute functions become possible: the wear reserve required in the case of conventional engines and the low shearing is displaced from the lubricants into the surface of the materials sliding against one another.

Ceramic materials are distinguished by high degrees of hardness, high melting points, low density, low thermal expansion, reduced corrosion and high resistance under thermal and chemical stresses. Therefore formed parts comprising ceramic materials are increasingly used wherever metallic materials no longer are sufficient to [counter] the mechanical, thermal or chemical stresses. Primarily aluminum oxide ($Al_2O_3$), zirconium oxide ($ZrO_2$), silicon nitride ($Si_3N_4$), silicon carbide (SiC), cubic boron nitride (BN), aluminum nitride (AlN) and boron carbide ($B_4C$) are considered to be materials which in the future will be suitable materials and coatings for the production of components for combustion engines.

However, like the parts of other materials, ceramic parts are also subject to abrasion. It is therefore necessary to ensure through suitable lubricants in their case also that the friction is kept at a minimum. Formulations have been presented for the solution of the problem of ways in which material losses due to friction of ceramic formed parts can be sufficiently prevented. In the following some suggestions toward a solution are listed:

According to one suggestion different materials such as oils, additives, polymers, solid sliding means and soaps are to be worked into ceramic composite materials before the fabrication of the ceramic formed part, through which the finished formed part obtains self-lubricating properties. However, the mechanical properties of the ceramic materials are disadvantageously changed through this process.

According to a further process, the surfaces of ceramic formed parts are to be coated with differing materials such as metal films, solid sliding means or polymer films in order to increase the ability to slide of the surfaces. However, such surface coatings are already abraded after a short time under mechanical, thermal or chemical stress of the ceramic parts since their wear reserve is low so that they are only temporarily effective.

A further possibility is the application of known soluble antifriction additives to a fluid lubricant, for example a mineral oil, which until now has customarily been used for reducing the friction of metal surfaces on one another. However, these means are based on a specific reaction with the metal surface whose atoms are bound ionically or covalently and for that reason cannot successfully be used with ceramic materials since the additives are not adsorbed by the ceramic surface or do not react chemically with it.

It has furthermore been proposed to disperse solid sliding substances, such as graphite or molybdenum disulfide, in oils and to apply these onto ceramic surfaces. Such solid substances, however, lead to occlusions of filters and must, moreover, be used in large quantities in order to be effective. Furthermore, in the presence of fluids on a surface, solid lubricants cannot form a solid film so that this proposal also does not solve the problem of attaining a satisfactory reduction of the friction losses of ceramic engines.

It has already been proposed in WO-A 92/07923 to use a fluid containing a monomer in order to reduce the friction losses of ceramic surfaces. Initially the monomer does not polymerize in the fluid, however, the polymerization is initiated by the flash temperature between the surfaces sliding past each other. In this process a polymer film is formed directly on the stressed surfaces. Thereby the monomers are consumed relatively rapidly and the lubricant must frequently be replaced.

None of the proposals for a solution known until now have yet been able to solve satisfactorily the problem of the reduction of the friction losses of mechanically, thermally or chemically stressed ceramic surfaces which is a prerequisite for combustion engines which do justice to their use in practice and have a long service life. However, since a tribologically and materially optimized engine does not make concessions to operating life and mechanical efficiency, specific minimum requirements are made as a result of the wear resistance and the coefficient of friction $\mu$. In the case of fluid friction which, at a low mixed friction component, the coefficient of friction $\mu$ obtaining in conventional engines is in the range from 0.001 to 0.01. Friction pairing within these limit values running completely dry are, however, neither known from the literature nor from the relevant tribodata bases, so that at least the system piston/[cylinder]liner must continue to be lubricated. But, in this case, instead of a mineral oil, a readily degradable medium should be used in such minimum quantities that during the life of the motor vehicle it must neither be necessary to change it or to add to it. In this case it is no longer noticed by the motor vehicle user, similarly to the way he no longer notices today the filling medium for gearing and climate systems.

The fluid medium which, according to the invention, assumes the tasks of a lubricant as well as also that of a cooling means, is referred to in the following as "operational fluid". Decisive for the lifetime-worthy operational fluid according to the invention is that it does not comprise a tribologically relevant and effective additive which also determines the replacement intervals. Rather, the tribologically relevant operating mechanism comprises that the basic oil of the operational fluid according to the invention enters into a tribology-dependent chemical reaction with the, for example, ceramic material surface. Since, in comparison to the additives, the basic oil is present in any desired quantity, it is not consumed.

The invention provides for the solution of the posed task an operational fluid for a lifetime-lubricated engine, which comprises as the basic fluid a polyalkylene glycol produced from ethylene oxide and propylene oxide to which an additive mixture is added, comprising a) 0.01–1.0 percent by weight of a reaction product of diphenyl amine and 2,4,4-trimethyl pentene;

b) 0.01–1.0 percent by weight of a pentaerythritol partially or completely esterified with an alkyl-substituted p-hydroxy propionic acid;

c) 0.01–1.0 percent by weight of a mono- or di-($C_4$–$C_8$) alkyl phosphoric acid ($C_{10}$–$C_{15}$) alkyl amide;

d) 0.01–1.0 percent by weight of triphenyl thiophosphate;

e) 0.01–0.1 percent by weight of a tolutriazol amino-methylated with a straight-chain or branched alkyl group with 2–10 carbon atoms, and/or f) 0.01–0.1 percent by weight of 1H-benzotriazol.

Such an operational fluid combines several advantages. The strongly friction- and wear-reducing effect of polyalkylene glycols makes them an ideal engine lubricant. This is surprising for the reason alone that polyalkylene glycols have previously virtually not been used in the area of engine lubrication. Motor oils for internal combustion engines today comprise largely mineral oil and mixtures of synthetic mineral oil and esters. Added to this is the fact that polyalkylene glycols have better thermic properties than mineral oils and can therefore also assume the task of a cooling means to absorb the process heat and for the structural part cooling of a combustion engine.

But is should be especially emphasized that polyalkylene glycols are physiologically completely harmless and have high biological degradability if the polyalkylene glycols are used in low mole masses. Products with mole masses of 4,000 g/mole are degraded in up to 80% within 28 days. The lower the mole masses, the higher is the biological degradability. The disposal of the operational fluid according to the invention is additionally facilitated thereby that it is free of the previously customary heavy metals which were customarily added up to now as wear protection and high pressure-additives and can be combusted free of smoke and sootlessly in the combustion engine.

In the composition of the operational fluid according to the invention great importance was placed on longterm stability. Experiments have shown that under conditions simulating practical use up to 2,000 operating hours and more, it ensures a sufficient tribological effect and cooling of the engine so that a single filling suffices for the entire operating life of the engine.

Excellent lubrication and cooling of the engine can be combined with optimum biological degradability of the operational fluid according to the invention if the polyalkylene glycol produced by polyaddition of ethylene oxide and propylene oxide has a molecular weight between 300 and 700 g/mole, preferably between 400 and 600 g/mole. This polyalkylene glycol should comprise ethylene oxide and propylene oxide at a ratio of weights of 30:70 to 70:30.

The excellent properties of the operational fluid according to the invention assume the addition of a balanced additive mixture.

Among the indispensible components of the additive mixture is a reaction product of diphenyl amine and 2,4,4-trimethyl pentene, with the molar ratio of diphenyl amine to 2,4,4-trimethyl pentene preferably being between 1:1.1 and 1:2.5. Such reaction products have already been described in EP-A-574 651 as components of fluid stabilizer mixtures for polyols.

As an antioxidant the pentaerythritol ester comprised in the additive mixture has been found to be especially useful if all four hydroxyl groups of the pentaerythritol are esterified with an alkyl-substituted p-hydroxy phenyl propionic acid. The phenyl moiety of the p-hydroxy phenyl propionic acid should preferably have an alkyl group in the 3-and/or 5-position. Especially advantageous are compounds with a branched alkyl group of 3 to 5 carbon atoms in the 3-and 5-position wherein the teriary butyl group has a preferred position.

A further component of the additive mixture is a phosphoric acid amide which is distinguished by especially valuable properties if it is derived from mono- or dihexyl phosphoric acid. Preferred are phosphoric acid alkyl amides produced therefrom in which the alkyl group comprises 10 to 15 carbon atoms.

Furthermore are also comprised one or several triazols in the additive mixture used according to the invention. Either in a mixture with the 1H-benzotriazol or also alone, the amino-methylated tolutriazol stabilizes the operational fluid according to the invention especially well if it is alkylated with one or two branched hydrocarbon groups each with 5 to 10 carbon atoms on the lateral nitrogen.

The good biological degradability of the basic fluid used for the operational fluid according to the invention is demonstrated by the following examples.

EXAMPLE 1

Growth Test of Land Plants

The basic fluid with a molecular weight of 460 mg/mole was tested for its possible inhibition effect on the growth of land plants according to OECD Guideline 208.

Differing quantities of the basic fluid were mixed with seminatural soil and test concentrations of 0, 1.0, 3.2, 10, 32, 100, 320 and 1,000 mg/kg of dry soil were tested. 10 seeds of two plant types, namely oats (Avena sativa) and lettuce (Lactuca sativa) were sown in four parallel containers containing soil samples with the above listed concentrations of the basic fluid. The containers were illuminated at 20 to 24.5° C. for 16 hours per day (6,500 to 6,600 lux) and subsequently kept in the absence of light for 8 hours. The containers were covered with glass plates. After the seedlings developed, five plants were removed from each container in order to obtain sufficient space for the remaining five plants. The test was subsequently continued for a period of 18 days. The following observations were recorded: germination of the seedlings, visual appearance of the young plants (including the recording of dead plants), and moist weight of the individual plants.

At none of the applied dosages could a marked delay be observed with respect to the germination of the seedlings of *Avena sativa* and *Lactuca sativa*. Moreover, no other unfavorable effects could be detected, such as the dying or leaf damages, in the case of the two plant types between 1 and 1,000 mg/kg of the tested basic fluid. Only the average moist weight (growth) in both plant types was slightly reduced at 1,000 mg/kg, which, however, was considered to be statistically insignificant. It can therefore be concluded that the effective concentrations for the germination of the seedling and the survival of the seedling of *Avena sativa* and *Lactuca sativa* in the case of the investigated basic fluid was equal to or greater than 1,000 mg/kg. For growth, the effective concentration with both plant types was considered to be 1,000 mg/kg.

EXAMPLE 2

Assessment of Biological Degradability

(Manometric Respirometry Test)

The biological degradability of the basic fluid with a molecular weight of 460 g/mole was tested in an aerated aqueous medium with the aid of the manometric respirometry test. The study corresponded to the OECD Guidelines for Testing of Chemical Number 301 F and Method C.4-D in Commission Directive 92/69/EEC.

Two parallel aqueous solutions of the material to be tested with concentrations of 100 mg/l were prepared; the test solutions were inoculated with activated sludge obtained from the city wastewater plant (final concentration corresponds to 30 mg/l of suspended solids). The following control solutions were prepared for the study:

1.) Two parallel inoculated controls comprised of the activated sludge and the inoculum to which no test material was added (blank test);

2.) a sample as a control, wherein aniline in a nutrient solution at a concentration of 100 mg/l and inoculum were added, and 3.) a sample as a control of toxicity which contained 100 mg/l of the basic fluid to be tested as well as also of the activated sludge and of the inoculum.

The samples were incubated at 21° C. in the absence of light in tightly closed containers and the test solutions were agitated with a magnetic agitator. The biological degradation was measured by the daily biological oxygen consumption. In addition, the concentrations of the dissolved organic carbon and the pH-value were measured at the beginning and at the end of the test.

Measured by the oxygen consumption, 89% of the tested basic fluid was biologically degraded. 100% of the dissolved organic carbon was consumed after 28 days. The extent of the biological degradation after 10 days was 64%. Consequently, the basic fluid can be considered to be biologically readily degradable. The toxicity control showed no marked toxic effects on the microorganisms contained in the sludge. The preparation with aniline used as a positive control under identical test conditions reached a biological degration of 87% after 28 days. This indicates that the inoculum and the test condititons were suitable.

EXAMPLE 3

Inhibition of Algae Growth in the Case of *Scenedesmus subspicatus*

The acute toxicity of the basic fluid with the molecular weight 460 g/mole in water was determined by the effect on the algae phylum *Scenedesmus subspicatus*. The study corresponded to the OECD Guideline for Testing of Chemicals Number 201 and to Method C.3 of Commission Directive 92/69/EEC and was carried out under GLP conditions.

Cells of *S. subspicatus* were placed for a period of 72 hours into six parallel samples of an aqueous nutritient solution (100 ml), of which each contained 100 mg/l of the basic fluid. Three further parallel samples were included in the tests as blank tests and contained no basic fluid. Incubation took place in a laboratory agitator at 24±1° C. under continuous illumination (7,000 lux). Samples of the algae suspensions were taken after 0, 24, 48, and 72 hours and the number of cells was determined with the aid of a spectrophotometer at 665 nm. As growth parameter, the area under the growth curve was determined.

This investigation demonstrated that the basic fluid at the concentrations used showed no inhibitory effect on the algae phylum *Scenedesmus subspicatus.*

EXAMPLE 4

Determination of Acute Toxicity of the Basic Fluid on Rainbow Trout

The acute toxicity of the basic fluid with the molecular weight of 460 g/mole on rainbow trout (*Oncorhynchus mykiss*) was carried out according to the method of the OECD Guidelines for Testing of Chemicals (1992) Number 203 denoted as Method C.1 of the Commission Directive 92/69/EEC under GLP conditions.

Two groups of ten fish each were subjected in an aqueous dispersion of the basic fluid at a concentration of 100 mg/l for a period of 96 hours under semistatic test conditions (daily renewal of the test medium).

A further group of ten fish was tested as a control under identical conditions, however without addition of the basic fluid. The fish were contained in aquaria containing 20 liters of the test medium. The temperature, pH-value and the oxygen concentration of the test solutions were recorded daily during the study. The mortality of the fish and other effects were observed after 3, 6, 24, 48, 72 and 96 hours.

No indications of cases of death or toxicities were observed in the test group or in the control group.

This demonstrates that the basic fluid shows no toxicity of any kind on rainbow trout at the concentrations used.

What is claimed is:

1. Operational fluid for a lifetime-lubricated engine, characterized in that it comprises as a basic fluid a polyalkylene glycol produced from ethylene oxide and propylene oxide to which is added an additive mixture comprising a) 0.01–1.0 percent by weight of a reaction product of diphenyl amine and 2,4,4-trimethyl pentene;

b) 0.01–1.0 percent by weight of a pentaerythritol partially or completely esterified with an alkyl-substituted p-hydroxy propionic acid;

c) 0.01–1.0 percent by weight of a mono- or di-($C_4$–$C_8$) alkyl phosphoric acid ($C_{10}$–$C_{15}$) alkyl amide;

d) 0.01–1.0 percent by weight of triphenyl thiophosphate;

e) 0.01–0.1 percent by weight of a tolutriazole amino-methylated with a straight-chain or branched alkyl group with 2–10 carbon atoms, and/or f) 0.01–0.1 percent by weight of 1H-benzotriazole.

2. Operational fluid as claimed in claim 1, characterized in that the polyalkylene glycol used as the basic fluid has a molecular weight of 300–700 g/mole and comprises ethylene oxide and propylene oxide at a ratio of weights of 30:70 to 70:30.

3. Operational fluid as claimed in claim 2, characterized in that the polyalkylene glycol used as the basic fluid has a molecular weight of 400–600 g/mole.

4. Operational fluid as claimed in claim 1, characterized in that in the reaction product, comprised in the additive mixture, of diphenyl amine and 2,4,4-trimethyl pentene the molar ratio of diphenyl amine to 2,4,4-trimethyl pentene is between 1:1.1 and 1:2.5.

5. Operational fluid as claimed in claim 1, characterized in that the pentaerythritol ester comprised in the additive mixture is esterified at all four hydroxyl groups with a ($C_2$–$C_{10}$) alkyl-substituted p-hyroxy phenyl propionic acid.

6. Operational fluid as claimed in claim 5, characterized in that the p-hydroxy phenyl propionic acid is substituted in the 3 and/or 5 position with a branched alkyl group of 3–5 carbon atoms.

7. Operational fluid as claimed in claim 1, characterized in that the phosphoric acid amide comprised in the additive mixture is a mono- or dihexyl phosphoric acid alkylamide with the alkylamide group comprising 10–15 carbon atoms.

8. Operational fluid as claimed in claim 1, characterized in that the amino-methylated tolutriazol comprised in the additive mixture is alkylated with one or two branched hydrocarbon groups each with 5–10 carbon atoms on the lateral nitrogen.

* * * * *